US005328428A

United States Patent [19]

Huang

[11] Patent Number: 5,328,428

[45] Date of Patent: Jul. 12, 1994

[54] MULTI-PURPOSE EXERCISER

[76] Inventor: Shih-Pin Huang, 4th Fl., No. 9, Lane 228, An Kang Rd., Taipei, Taiwan

[21] Appl. No.: 70,661

[22] Filed: Jun. 2, 1993

[51] Int. Cl.[5] ..... A63B 21/062

[52] U.S. Cl. ..... 482/98; 482/99; 482/101; 482/102; 482/142

[58] Field of Search ..... 482/17, 38–42, 482/97–104, 135, 908, 106, 142, 133, 134, 136–138

[56] References Cited

U.S. PATENT DOCUMENTS

| | | | |
|---|---|---|---|
| 4,564,194 | 1/1986 | Dawson | 482/98 X |
| 4,826,157 | 5/1989 | Fitzpatrick | 482/99 X |
| 4,856,773 | 8/1989 | Deolia | 482/102 |
| 4,902,002 | 2/1990 | Huang | 482/908 X |
| 4,955,604 | 9/1990 | Pogue | 482/106 X |
| 4,974,838 | 12/1990 | Sollenberger | 482/102 X |
| 5,082,259 | 1/1992 | Gonzalez | 482/142 X |
| 5,184,992 | 2/1993 | Banks | 482/98 X |

FOREIGN PATENT DOCUMENTS

| | | | |
|---|---|---|---|
| 194220 | 9/1986 | European Pat. Off. | 482/101 |
| 2627090 | 8/1989 | France | 482/142 |

*Primary Examiner*—Robert Bahr

*Attorney, Agent, or Firm*—Omri M. Behr; Matthew J. McDonald

[57] ABSTRACT

An exerciser includes a weighted base, a pair of spaced vertical beams, a resistance assembly mounted in each vertical beam, a lifting bar with two ends thereof respectively and removably mounted to each resistance assembly at a desired height, and a foldable bench.

16 Claims, 5 Drawing Sheets

MULTI-PURPOSE EXERCISER

BACKGROUND OF THE INVENTION

The present invention relates to multi-purpose exercisers which provides weight lifting, hands and legs pulling, and horizontal bar exercises.

For modern people who do not have much time and space to exercise, exercisers provide an excellent means therefor. A conventional exerciser usually includes a weight lifting means in which the exerciser lies on a bench and pushes a lifting bar connected to a resistance means. The exerciser, however, might be injured if he does not have enough arm strength to slowly put down the lifting bar or the lifting bar does not align with the supporting seat on which it should rest. Another disadvantage of conventional exercisers is that the bench is not foldable and thus occupies a certain space. A further disadvantage of conventional exercisers is that the lifting bar is not adjustable in height. The present invention provides an improved multi-purpose exercise to mitigate and/or obviate the problems in the conventional exercisers.

SUMMARY OF THE INVENTION

The present invention provides an exerciser which includes a weighted base, a pair of spaced vertical beams, a resistance assembly mounted in each vertical beam, a lifting bar with two ends thereof respectively and removably mounted to each resistance assembly at a desired height, and a foldable bench.

Each resistance assembly includes a vertical plate in associated vertical beam and an insert attached to a lower end of the vertical plate. A plurality of first pegs are provided on a front side of the plate and spaced in vertical direction. The lifting bar is removably mounted to one pair of horizontally aligned pegs on the plates by an engaging block which is mounted on each plate adjacent to each peg. The engaging block has a first end pivoted to the plate and a second end releasably engaged to a cutout formed in each end of the lifting bar.

A horizontal beam extends outward from a top section of each vertical beam and having a pulley mounted to a distal end thereof. A second peg is provided to a rear side of the plate. A cable passing through the pulley has a first end attached to the second peg and a second end on which a hand grip is attached for hand exercise.

A second pulley may be provided to a lower end of each vertical beam, and a second cable passing through the second pulley is provided to engage with the first cable at a first end thereof. A leg hook may be provided to engage with the second end of the second cable for leg exercise. Preferably, a further peg may be mounted to an upper section of each vertical beam for engaging with an upper end of the second cable when not in use.

A horizontal bar is securely mounted between upper portions of the vertical beams for adults, and a second horizontal bar may be provided between mediate portions of the vertical beams for short exercisers. Preferably, a first end of the horizontal bar is pivoted to one of the vertical beams and a bracket is mounted to the other vertical beam to support the other end of the lower horizontal bar.

The present invention further provides a foldable bench means which comprises a supporting bar having an end pivoted to one of the vertical beams, a bracket mounted to the other vertical beam to support the other end of the supporting bar when the bench means is in use, a bench having a first end to which leg means is pivotally connected and a second end to which a socket is attached to receive and be slidable along the supporting bar, and a pivotal block mounted between the bench and the socket to allow a pivotal movement therebetween.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
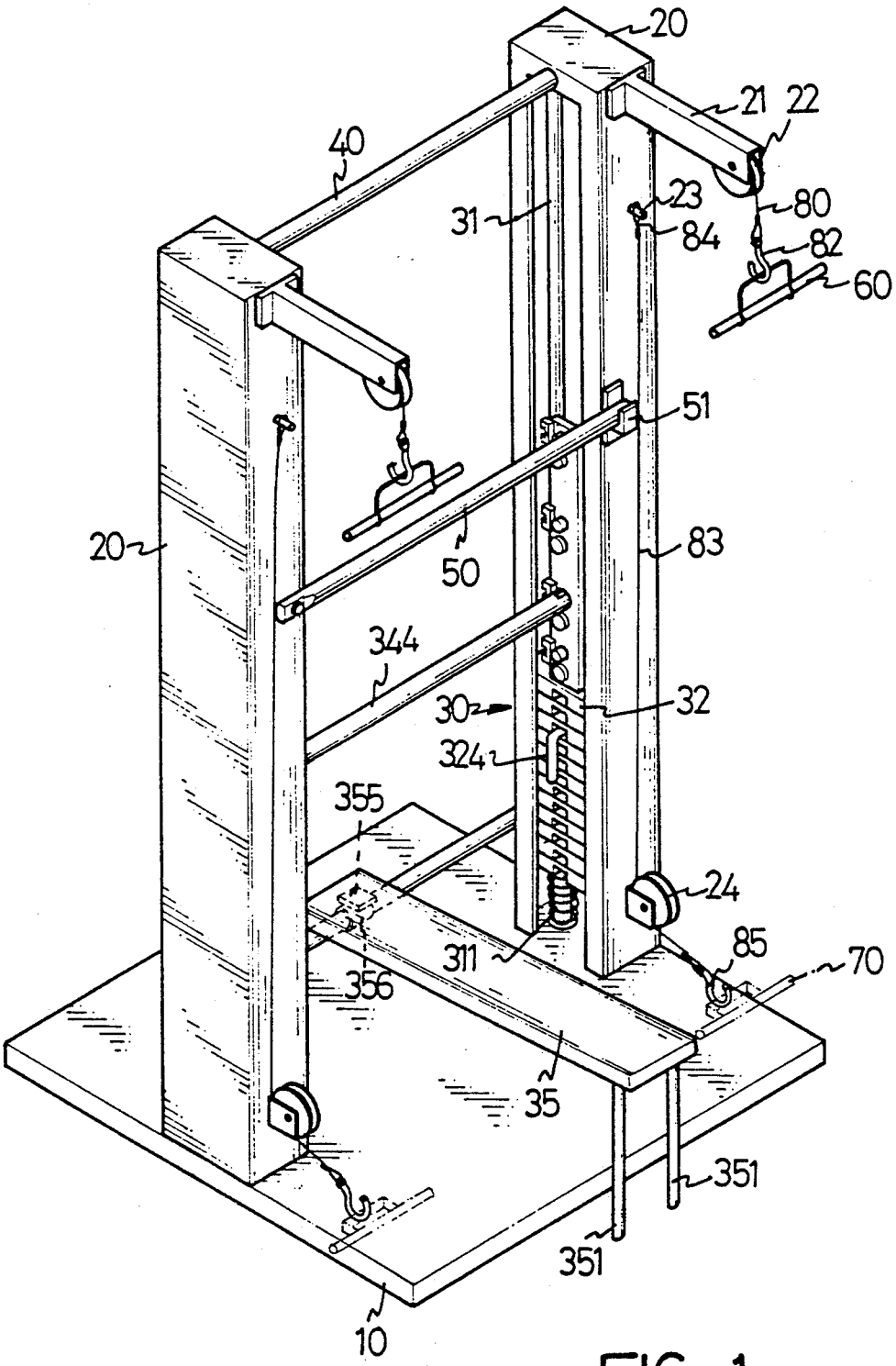
FIG. 1 is a perspective view of a multi-purpose exerciser in accordance with the present invention.

Referring to the drawings and initially to FIG. 1, a multi-purpose exerciser in accordance with the present invention generally includes a substantially rectangular weighted base 10 on which a pair of spaced vertical beams 20 is mounted. A resistance assembly 30 is mounted in each of the vertical beams 20. A horizontal bar 40 is securely mounted between upper portions of the vertical beams 20 such that the user may practice pull up or other horizontal bar skills on it. Additionally, a lower horizontal bar 50 may be provided between mediate portions of the vertical beams 20 for short users, youth, or children. Preferably, the horizontal bar 50 has an end pivoted to one of the vertical beams 20 and a bracket 51 is mounted to the other vertical beam 20 to support the other end of the horizontal bar 50 when in use.

Figure 3:
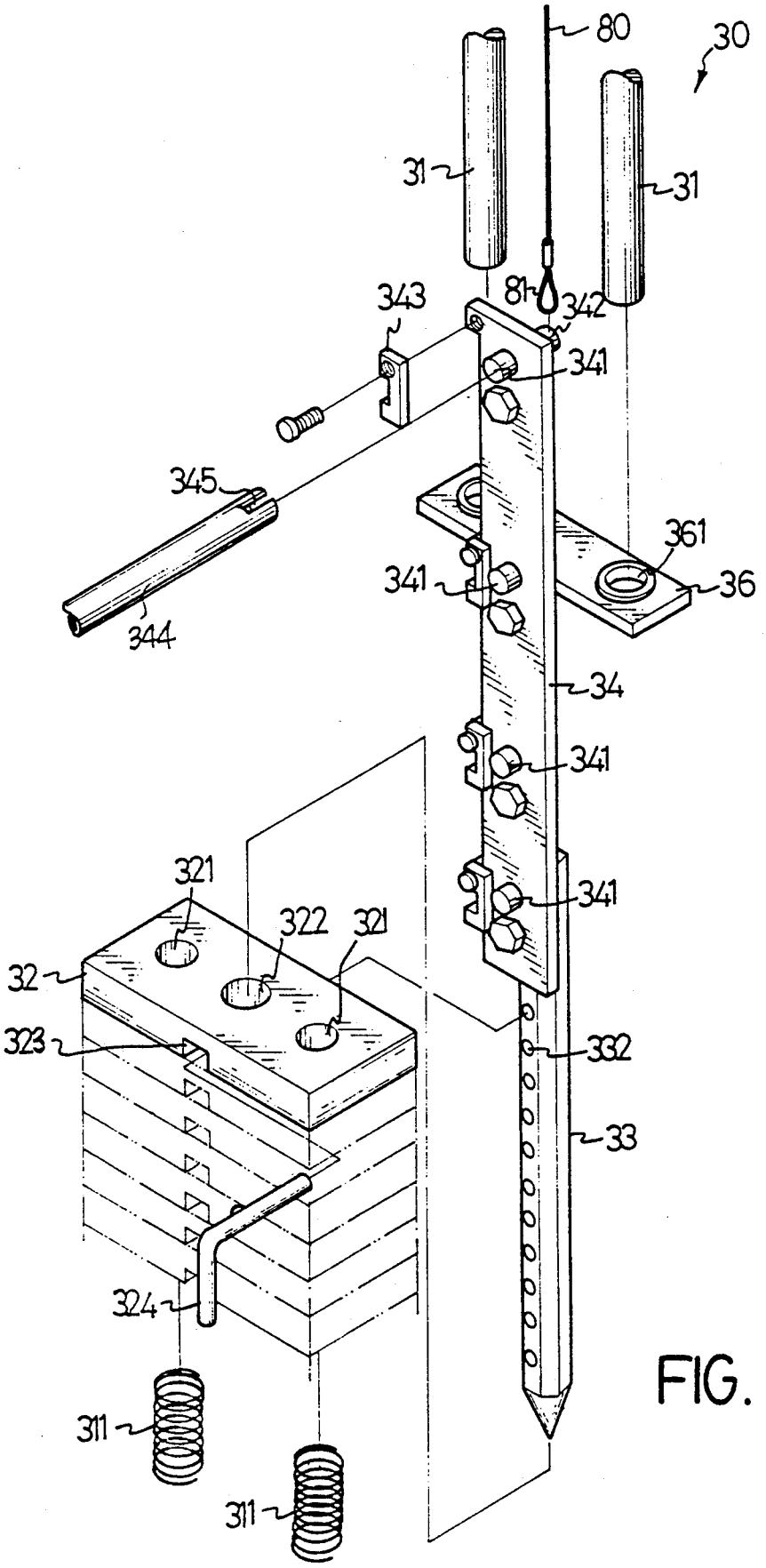
FIG. 3 is an exploded view showing detailed structure of the resistance assembly of the multi-purpose exerciser.

Referring to FIG. 3, the resistance assembly 30 includes a vertical plate 34 with an insert rod 33 connected to a lower end thereof and a guiding plate 36 secured to a mediate section thereof. The resistance assembly 30 further includes two spaced rods 31 extending vertically in each vertical beam 20 and passing two guiding holes 361 in the guiding plate 36. Mounted to a lower end of each vertical rod 31 is a spring 311 above which a resistance means consisting of a plurality of weights 32 is mounted. Each weight 32 has three through holes, a central one 322 through which the insert rod 33 passes and two side ones 321 through which the vertical rods 31 pass. An insert hole 323 is formed in a middle of each weight 32 through which a pin 324 is inserted to engage with one of the associated aligned holes 332 in the insert rod 33, by which the user may decide how many weights 32 are to be lifted.

Figure 4:
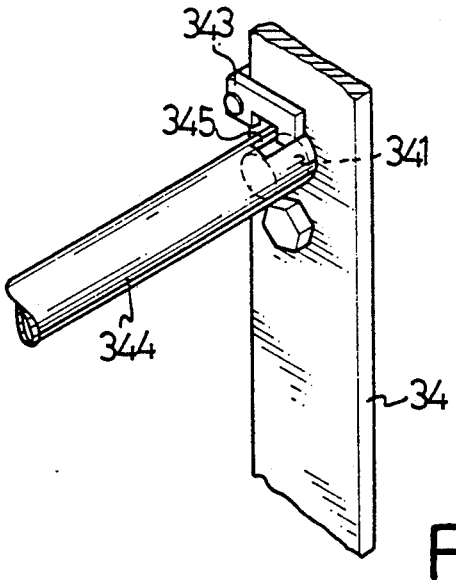
FIG. 4 is a perspective view illustrating the coupling of the lifting bar and the resistance assembly.

A plurality of first pegs 341 are provided on a front side of the plate 34 and spaced in vertical direction. Adjacent to each first peg 341 is a substantially U-shaped engaging block 343 which is pivoted to the plate 34 at one end thereof. As shown in FIG. 4, a lifting bar 344 is mounted to the plates 34 in which two horizontally aligned pegs 341 on the two plates 34 in the two vertical beams 20 are received in both ends of the lifting bar 344, and the other free ends of two horizontally aligned engaging blocks 343 respectively engage with a cutout 345 formed in each end of the lifting bar 344. By such an arrangement, the lifting bar 344 may be selectively mounted to the plate 34 in different heights to suit different users. As shown in FIG. 1, each vertical beam 20 has .an opening so that the insert holes 323 in the weights 32 and the engaging blocks 343 are accessible to the user.

Figure 5:
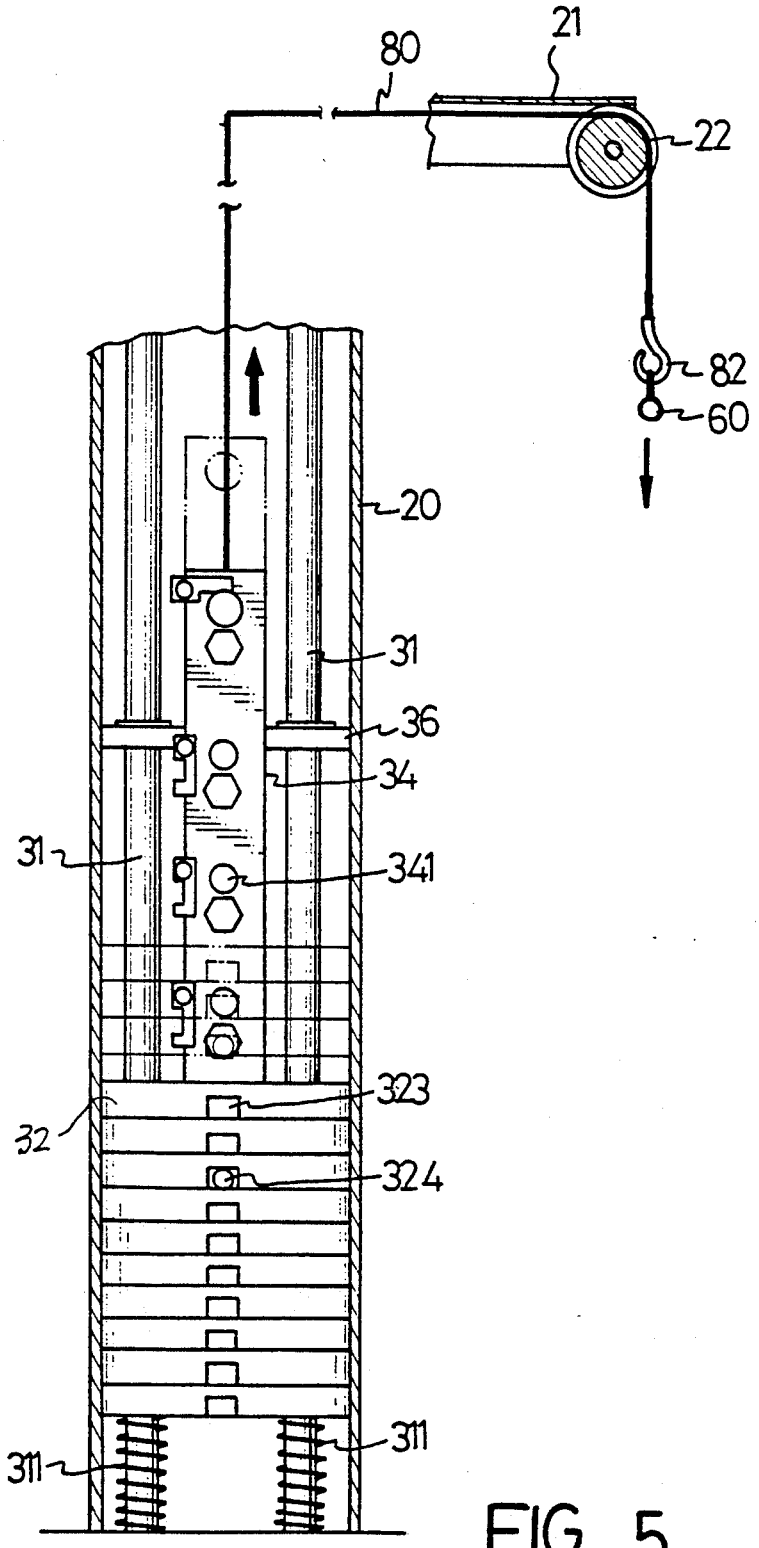
FIG. 5 is a cross-sectional view illustrating the motion of the resistance assembly during hand exercising.

A second peg 342 is provided to a rear side of the plate 34 (see FIG. 3). Referring to FIGS. 1 and 5, a beam 21 extends outwardly and horizontally from a top section of each vertical beam 20 with a pulley 22 mounted to a distal end thereof. A cable 80 passing through the pulley 22 has a first loop end 81 engaged to the second peg 342 and a second hooked end 82 on which a hand grip 60 is attached. As shown in FIG. 5, when the user applies a downward force, the weights 32 together with the plate 34 are lifted to provide an arm exercising effect.

Figure 2:
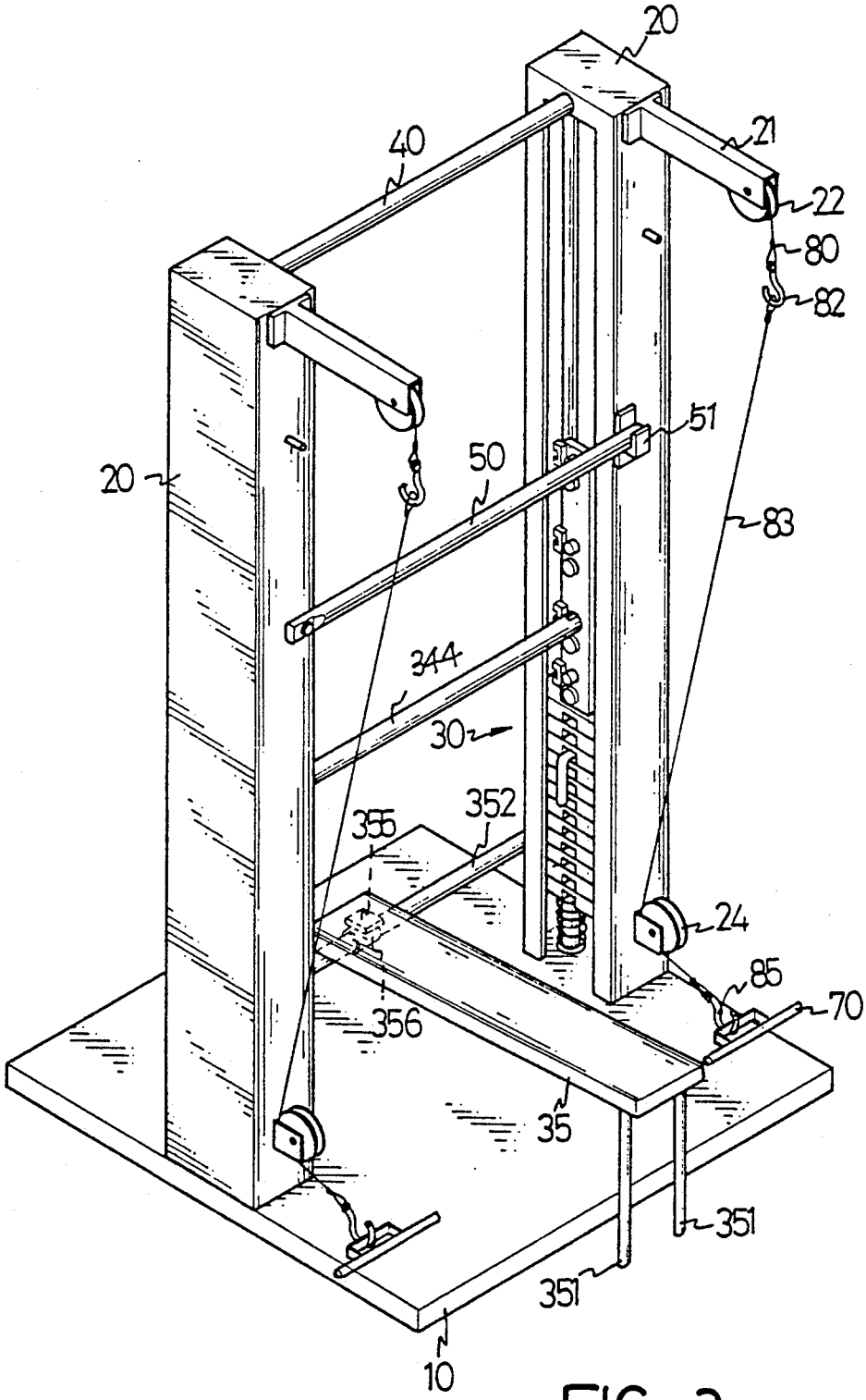
FIG. 2 is a perspective view of the multi-purpose exerciser when used for leg exercise.

Referring to FIG. 2, a second pulley 24 is provided to the lower end of each vertical beam 20. If the user wishes to exercise his legs, he may attached a first loop end 84 of a second cable 83 (which passes through the second pulley 24) to the second hooked end 82 of each first cable 80 and attach a leg hook 70 to the second hooked end 85 of each second cable 83, thereby allowing a leg exercise. When the second cable 83 is not to be used, the first loop end 84 thereof may be hooked on a peg 23 mounted to an upper section of each vertical beam 20, as shown in FIG. 1.

Figure 6:
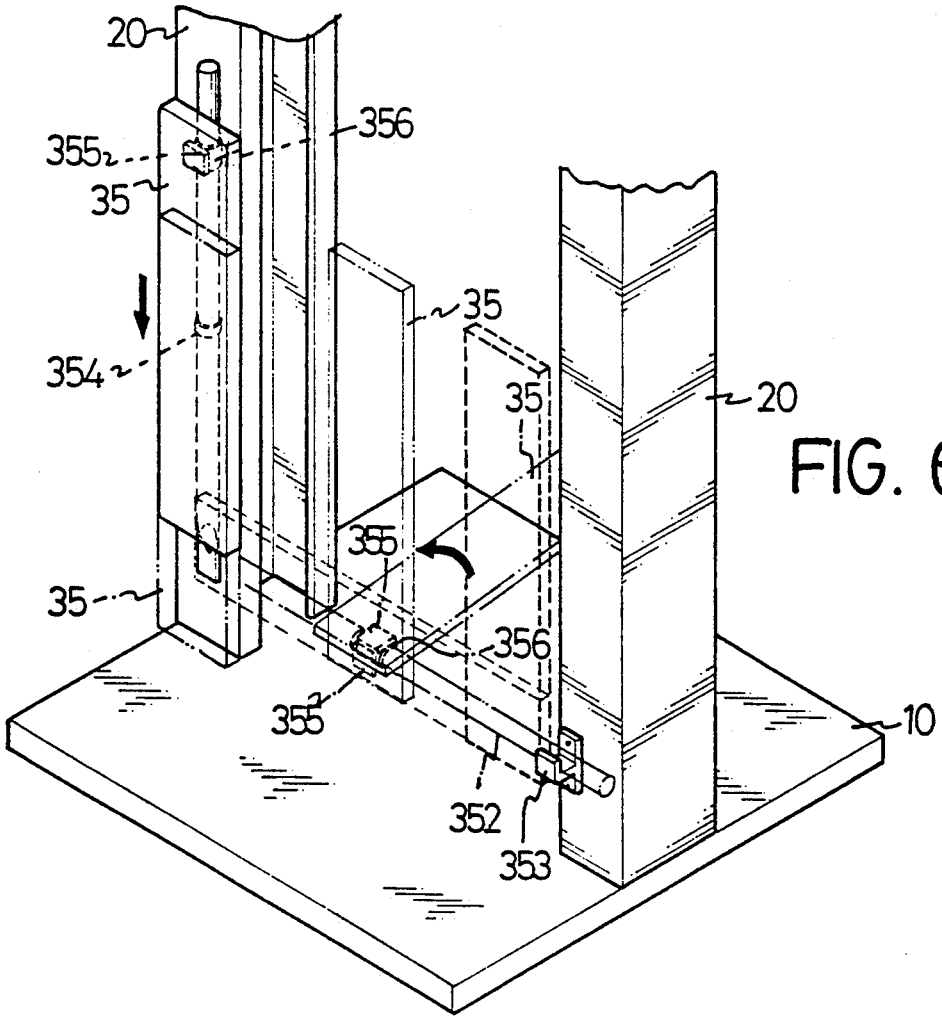
FIG. 6 is a partial perspective view illustrating the folding of the exerciser bench.

Referring to FIGS. 1 and 6, the exerciser further has a foldable bench means which includes a supporting bar 352 having an end pivoted to one of the vertical beams 20, a bracket 353 mounted to the other vertical beam 20 to support the other end of the supporting bar 352 when the bench means is in use, and a bench 35 with a first .end to which bench legs 351 are pivotally connected. The bench 35 has a socket 356 provided to a second end thereof to slidably receive the supporting bar 352. A pivotal block 355 is mounted between the bench 35 and the socket 356 to allow a pivotal movement therebetween. An annular flange 354 is formed on a mediate section of the supporting bar 352 to stop the socket 356 when the bench 35 is in a storage position.

As shown in FIG. 6, when the bench is not to be used, the bench legs 351 are firstly folded and the bench 35 is pivoted through 90°. Then, the bench 35 is urged to slide toward the free end of the supporting bar 352 and is then pivoted counterclockwise through 90° and thus lies in the same direction with the supporting rod 352. Thereafter, the supporting bar 352 together with the bench 35 are pivoted counterclockwise through 90° about the pivoted end of the supporting bar 352. Subsequently, the bench 35 slides downward until it touches and thus rests on the base 10 where the socket 356 contacts and is stopped by the annular flange 354.

Although the invention has been explained in relation to its preferred embodiment, it is to be understood that many other possible modifications and variations can be made without departing from the spirit and scope of the invention as hereinafter claimed.

I claim:

1. An exerciser comprising:

a weighted base (10);

a pair of spaced vertical beams (20);

a resistance assembly (30) mounted in each said vertical beam (20); and a bench means comprising:

a supporting bar having a first end pivoted to one of said vertical beams and a second end, a bracket (353) being mounted to the other vertical beam (20) to support said second end of said supporting bar when said bench means is in use; and a bench (35) having first and second ends, a leg means (351) being pivotally connected to said first end of said bench, a socket (356) being mounted to said second end of said bench (35) to receive and be slidable along said supporting bar (352), and a pivotal block (355) mounted between said bench (35) and said socket (356) to allow a pivotal movement therebetween.

2. The exerciser as claimed in claim 1 wherein said supporting bar (3520 has an annular flange (354) on a mediate section thereof, said socket rests on said annular flange (354) when said bench (35) is in a storage position.

3. The exerciser as claimed in claim 1 further comprising a first horizontal bar (40) securely mounted between upper portions of said vertical beams (20).

4. The exerciser as claimed in claim 3 further comprising a second horizontal bar (50) provided between mediate portions of said vertical beams (20).

5. The exerciser as claimed in claim 4 wherein said horizontal bar includes a first end pivoted to one of said vertical beams (20) and a second end, a bracket (51) being mounted to the other vertical beam (20) to support said second end of said horizontal bar (50).

6. An exerciser comprising:

a weighted base (10);

a pair of spaced vertical beams (20);

a vertical plate (34) mounted in each said vertical beam (20) with an insert rod (33) connected to a lower end thereof, said insert rod (33) having a plurality of vertically spaced holes (332) therein;

two spaced vertical rods (31) extending in each said vertical beam (20), each said vertical rod (31) having a spring (311) mounted to a lower end thereof;

a plurality of weights (32) mounted above said springs (311), each said weight (32) having a central through hole (322) through which said insert rod (33) passes, two side through holes (321) through which said vertical rods (31) pass, and an insert hole (323) formed in a middle thereof, a pin (324) being inserted through one of said insert holes (323) to engage with one of the associated aligned holes (332) in said insert rod (33);

said plate having a front side, said front side of said plate having a plurality of pegs (341) spaced in a vertical direction;

a lifting bar (344) having two ends and being removably mounted to two horizontally aligned said pegs (341) respectively provided on said plates (34) in said vertical beams (20); and means for releasably mounting said two ends of said lifting bar to said pegs (341) of said plates (34).

7. The exerciser as claimed in claim 6 wherein each said end of said lifting bar (344) has a cutout (345) therein, said means for releasably mounting said lifting bar including an engaging block (343) mounted on each said plate adjacent to each said peg (341), said engaging block having a first end pivoted to said plate and a second end releasably engaged to said cutout (345) formed in each said end of said lifting bar (344).

8. The exerciser as claimed in claim 6 wherein each said vertical beam has a horizontal beam (21) extending outward from a top section thereof, said horizontal beam (21) having a pulley (22) mounted to a distal end thereof;

each said plate having a rear side, said rear side of each said plate having a second peg (342) thereon, a cable (80) passing through said pulley (22) and having a first end (81) attached to said second peg (342) and a second end (82), a hand grip (60) being removably attached to said second end (82) of said second cable (80).

9. The exerciser as claimed in claim 8 wherein each said vertical beam (20) has a second pulley (24) provided to a lower end thereof, and a second cable (83) passing through said second pulley (24) and having a first end (84) releasably attached to said second end (82) of said first cable (80) and a second end (85), a leg hook (70) being removably attached to said second end (85) of said second cable (83).

10. The exerciser as claimed in claim 9 wherein each said vertical beam (20) has a third peg (23) mounted to an upper section thereof for engaging with said first end (84) of said second cable (83) when not in use.

11. The exerciser as claimed in claim 6 wherein said vertical plate (34) has a guiding plate (36) secured to a mediate section thereof, said guiding plate (36) having two guiding holes (361) through which said guiding rods (31) pass.

12. The exerciser as claimed in claim 6 further comprising a bench means comprising:

a supporting bar (352) having a first end pivoted to one of said vertical beams (20) and a second end, a bracket (353) being mounted to the other vertical beam (20) to support said second end of said supporting bar when said bench means is in use; and a bench (35) having first and second ends, a leg means (351) being pivotally connected to said first end of said bench, a socket (356) being provided to said second end of said bench to receive and be slidable along said supporting bar (352), and a pivotal block (355) mounted between said bench (35) and said socket (356) to allow a pivotal movement therebetween.

13. The exerciser as claimed in claim 12 wherein said supporting bar (352) has an annular flange (354) formed on a mediate section thereof, said socket (356) rests on said annular flange (354) when said bench (35) is in a storage position.

14. The exerciser as claimed in claim 6 further comprising a first horizontal bar (40) securely mounted between upper portions of said vertical beams (20).

15. The exerciser as claimed in claim 14 further comprising a second horizontal bar (50) provided between mediate portions of said vertical beams (20).

16. The exerciser as claimed in claim 15 wherein said horizontal bar includes a first end pivoted to one of said vertical beams (20) and a second end, a bracket (51) being mounted to the other vertical beam (20) to support said second end of said horizontal bar (50).

* * * * *